US011180294B2

(12) United States Patent
Lei

(10) Patent No.: US 11,180,294 B2
(45) Date of Patent: Nov. 23, 2021

(54) CONTAINER WITH SECURITY LOCK

(71) Applicant: Jing Lei, Guangdong (CN)

(72) Inventor: Jing Lei, Guangdong (CN)

(73) Assignee: DONGGUAN LK TIN PACKAGING CO., LTD., Dongguan (CN)

( * ) Notice: Subject to any disclaimer, the term of this patent is extended or adjusted under 35 U.S.C. 154(b) by 0 days.

(21) Appl. No.: 16/858,525

(22) Filed: Apr. 24, 2020

(65) Prior Publication Data

US 2020/0407131 A1 Dec. 31, 2020

Related U.S. Application Data

(60) Provisional application No. 62/867,371, filed on Jun. 27, 2019.

(51) Int. Cl.

| | |
|---|---|
| ***B65D 50/04*** | (2006.01) |
| ***A61J 1/03*** | (2006.01) |
| ***B65D 43/16*** | (2006.01) |

(52) U.S. Cl.

CPC ..... *B65D 50/046* (2013.01); *A61J 1/03* (2013.01); *B65D 43/16* (2013.01); *B65D 2215/02* (2013.01)

(58) Field of Classification Search

CPC .. B65D 50/046; B65D 43/16; B65D 43/0212; B65D 5/44; B65D 5/443; B65D 5/445; B65D 59/04; B65D 77/042; B65D 9/08; B65D 2543/00731; B65D 2543/00805; B65D 2543/00537; B65D 2543/00648; B65D 2543/00694; B65D 2543/00194; B65D 2543/00277; B65D 2543/00296; B65D 2215/02

USPC ..... 206/1.5, 531, 540, 528, 535, 38, 267, 206/468, 828; 220/345.3, 351, 345.2, 220/345.4, 326, 345.1, 324, 28, 788, 835, 220/780, 784, 812–813; 215/209, 215/201–202, 216; 221/154, 282, 45

See application file for complete search history.

(56) References Cited

U.S. PATENT DOCUMENTS

| | | | | | |
|---|---|---|---|---|---|
| 2,083,356 | A * | 6/1937 | Batdorf | B65D 43/12 | 220/351 |
| 2,093,508 | A * | 9/1937 | Batdorf | B65D 43/12 | 220/351 |
| 2,117,228 | A * | 5/1938 | Stuchbery | B65D 43/164 | 220/841 |
| 2,295,747 | A * | 9/1942 | Mills | B65D 43/12 | 220/351 |
| 2,492,864 | A * | 12/1949 | Hermani | B65D 43/164 | 206/540 |
| 2,813,653 | A * | 11/1957 | Grossman | B65D 43/12 | 220/345.2 |
| 2,906,428 | A * | 9/1959 | Fralick | B65D 43/164 | 220/283 |

(Continued)

*Primary Examiner* — J. Gregory Pickett
*Assistant Examiner* — Brijesh V. Patel
(74) *Attorney, Agent, or Firm* — Justin Lampel

(57) ABSTRACT

A container with a security lock is provided. The container has a top unit and a bottom unit. The bottom unit may have a first side and a second side wherein the first side and the second side each have a compressible tab. The top unit may have a first opening and a second opening wherein the first opening and the second opening receive a portion of the compression tabs when the top unit is locked to the bottom unit.

8 Claims, 6 Drawing Sheets

(56) References Cited

U.S. PATENT DOCUMENTS 3,604,582 A * 9/1971 Boudin ..... B65D 50/06 215/202
3,782,584 A * 1/1974 Swenson ..... B65D 43/12 220/345.3
3,894,654 A * 7/1975 Frankenberg ..... B65D 43/165 220/283
3,942,630 A * 3/1976 Phillips ..... B65D 43/12 206/1.5
3,987,891 A * 10/1976 Horvath ..... B65D 11/12 206/1.5
4,126,224 A * 11/1978 Laauwe ..... B65D 50/06 206/540
4,342,403 A * 8/1982 Badtke ..... B65D 43/12 206/540
4,344,646 A * 8/1982 Michel ..... A45C 13/1084 220/326
4,485,915 A * 12/1984 Berghahn ..... B65D 50/045 206/1.5
4,561,544 A * 12/1985 Reeve ..... B65D 11/12 206/1.5
4,889,238 A * 12/1989 Batchelor ..... B65D 50/06 206/535
4,946,057 A * 8/1990 Connolly ..... B65D 25/22 206/45.28
5,033,634 A * 7/1991 Batchelor ..... B65D 50/045 206/1.5
5,080,222 A * 1/1992 McNary ..... B65D 50/045 206/1.5
5,337,913 A * 8/1994 Fukuda ..... E05C 19/06 220/326
5,348,356 A * 9/1994 Moulton ..... E05B 37/20 292/80
5,575,399 A * 11/1996 Intini ..... B65D 21/0233 220/835
5,711,417 A * 1/1998 Tilve ..... A45C 11/04 206/6
5,740,938 A * 4/1998 Hofmann ..... A45C 11/328 206/37
5,918,956 A * 7/1999 Scholder ..... F16B 12/26 312/223.2
6,021,901 A * 2/2000 Wolfe ..... A45C 11/328 206/37
6,210,638 B1 * 4/2001 Grieco ..... A61L 2/26 220/345.1
6,618,983 B1 * 9/2003 Spragins ..... A01M 1/14 43/107
6,832,686 B2 * 12/2004 Donegan ..... B65D 43/20 220/345.1
7,661,534 B2 * 2/2010 Saclier ..... B65D 43/12 220/345.2
7,721,908 B2 * 5/2010 Cronin ..... B65D 11/12 206/531
7,757,843 B2 * 7/2010 Katsis ..... B65D 83/0463 206/532
7,918,357 B2 * 4/2011 Jaeb ..... A45C 13/1084 220/4.22
8,162,144 B2 * 4/2012 Intini ..... B65D 83/0463 206/532
8,453,840 B2 * 6/2013 Wharton ..... B65D 11/12 206/531
8,540,113 B2 * 9/2013 Bailey ..... B65D 43/164 220/810
8,689,978 B2 * 4/2014 Flood ..... B65D 83/04 206/535
8,708,149 B2 * 4/2014 Hawry ..... B65D 43/162 206/535
8,727,120 B2 * 5/2014 Caron ..... B65D 75/326 206/468
8,910,781 B2 * 12/2014 Pipes ..... A24F 23/00 206/242
9,375,383 B1 * 6/2016 Wang ..... A61J 7/0076
9,938,042 B1 * 4/2018 Aryanpanah ..... B65D 50/04
D856,676 S * 8/2019 Basak-Smith ..... B65D 21/0233 220/835
2002/0056652 A1 * 5/2002 Kawamura ..... A45C 11/328 206/37
2004/0045858 A1 * 3/2004 Harrold ..... B65D 83/0463 206/470
2004/0108318 A1 * 6/2004 Wang ..... B65D 43/12 220/345.2
2004/0217116 A1 * 11/2004 Offerman ..... B65D 43/12 220/345.2
2007/0051726 A1 * 3/2007 Arkins ..... B65D 43/20 220/345.1
2009/0255842 A1 * 10/2009 Brozell ..... B65D 83/0463 206/531
2009/0283437 A1 * 11/2009 Angelucci ..... B65D 83/0463 206/530
2010/0038278 A1 * 2/2010 Gattefosse ..... B65D 50/046 206/531
2010/0072206 A1 * 3/2010 Doyle ..... B65D 43/12 220/345.2
2011/0000931 A1 * 1/2011 Gelardi ..... B65D 11/12 206/531
2018/0178953 A1 * 6/2018 Corners ..... F16B 12/26 312/223.2

* cited by examiner

CONTAINER WITH SECURITY LOCK

CROSS REFERENCE TO RELATED APPLICATIONS

The following application is a based on and claims the priority benefit of U.S. provisional application Ser. No. 62/867,371 filed Jun. 27, 2019 currently; the entire content of which is incorporated by reference.

BACKGROUND OF THE INVENTION

A container with a security lock is provided. The container has a top unit and a bottom unit. The bottom unit may have a first side and a second side wherein the first side and the second side each have a compressible tab. The top unit may have a first opening and a second opening wherein the first opening and the second opening receive a portion of the compression tabs when the top unit is locked to the bottom unit.

Containers with security locks are known. For example, U.S. Pat. No. 9,481,496 to Cottle discloses a child resistant container for nicotine products. The container comprises latching elements adapted to interlock with cooperating latching elements when said lid is pushed onto a said base to retain said lid to said base. The latching elements are further adapted to disengage from said cooperating latching elements when a simultaneous force is exerted on all releasable latching arrangements by two hands of a user or the like.

Further, U.S. Pat. No. 9,187,220 to Biesecker discloses a cap having a top wall, an outer peripheral edge, a first section, and a second section. A skirt depends from the outer peripheral edge. The skirt includes an attached end, a free end, a plurality of slots, and a plurality of apertures. Each aperture is spaced-apart from the free end of the skirt. The top wall has a first configuration and a second configuration. When the top wall is in the first configuration, the first section is generally planer and the second section is generally arcuate. When the top wall is in the first configuration, the skirt extends generally perpendicularly to the first section to generally engage at least a portion of a container. When the top wall is in the second configuration, the free end of the skirt extends radially outwardly from the attached end thereof to allow the cap to be removed from the container.

Still further, U.S. Pat. No. 8,931,657 to Kientzle discloses a pharmaceutical container having a bottle having a bottom wall and side walls. A ridge proximate to the bottom wall projects from an interior surface of at least one of the side walls, to facilitate nested stacking of a plurality of bottles. One or more of the side walls includes a cover locking receptacle proximate to the top end of the side wall. The pharmaceutical container also includes a cover including a sliding lid contained in a cover housing. The cover housing has a top wall, which includes an opening, and cover side walls. A child-resistant closure mechanism is also provided to limit the movement between the sliding lid and the bottle.

However, these patents fail to describe a container with a security lock which is easy to use. Further, these patents fail to provide for a container with a security lock which allows a user to unlock a child-resistant container in a simple and safe manner.

SUMMARY OF THE INVENTION

A container with a security lock is provided. The container has a top unit and a bottom unit. The bottom unit may have a first side and a second side wherein the first side and the second side each have a compressible tab. The top unit may have a first opening and a second opening wherein the first opening and the second opening receive a portion of the compression tabs when the top unit is locked to the bottom unit.

An advantage of the present child resistant storage container is that the present child resistant storage container is easy to use for adults while preventing children from gaining access to the interior of the container. The device is also especially suitable for seniors which typically have difficulty opening child resistant containers.

Still another advantage of the present child resistant storage container is that the present container lacks exterior sharp edges and corners which may otherwise injure someone.

For a more complete understanding of the above listed features and advantages of the container with a security lock reference should be made to the detailed description and the drawings. Further, additional features and advantages of the invention are described in, and will be apparent from, the detailed description of the preferred embodiments.

DETAILED DESCRIPTION OF THE PREFERRED EMBODIMENTS

A container with a security lock is provided. The container has a top unit and a bottom unit. The bottom unit may have a first side and a second side wherein the first side and the second side each have a compressible tab. The top unit may have a first opening and a second opening wherein the first opening and the second opening receive a portion of the compression tabs when the top unit is locked to the bottom unit.

Figure 1:
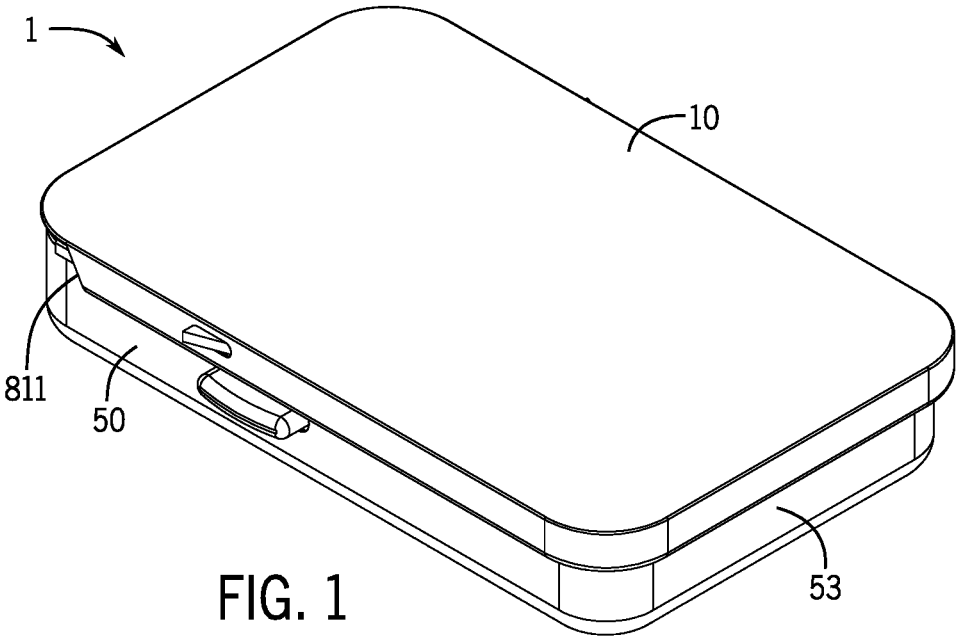
FIG. 1 illustrates a perspective view of the container with a security lock wherein the top unit is secured to the bottom unit in the closed form.
Figure 2:
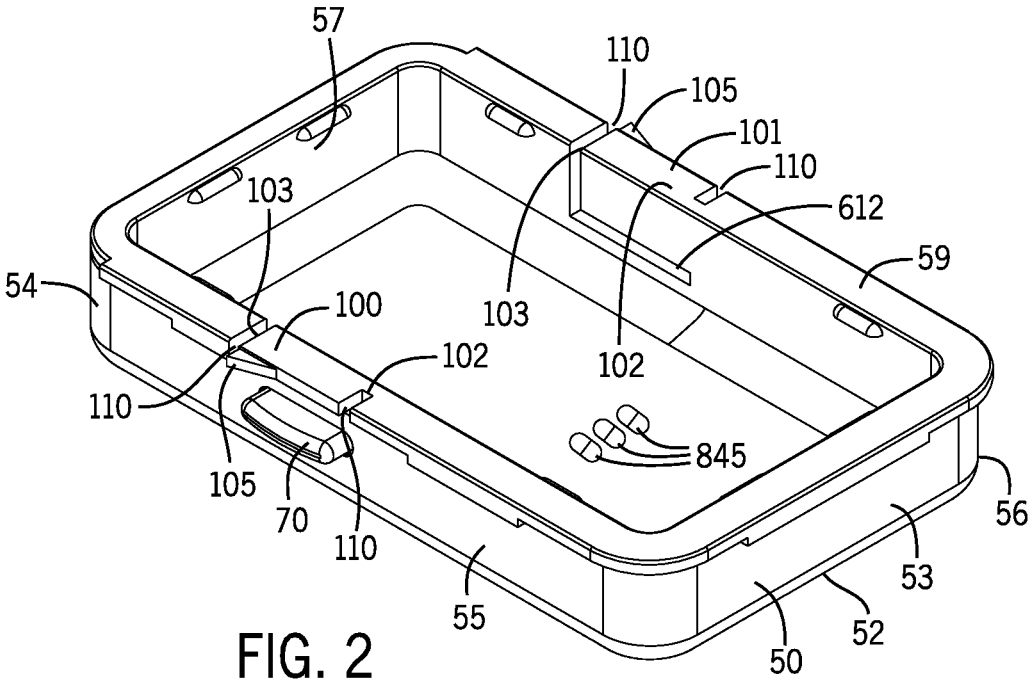
FIG. 2 illustrates a perspective view of the bottom unit (removed from the top unit) of the container with a security lock.
Figure 5:
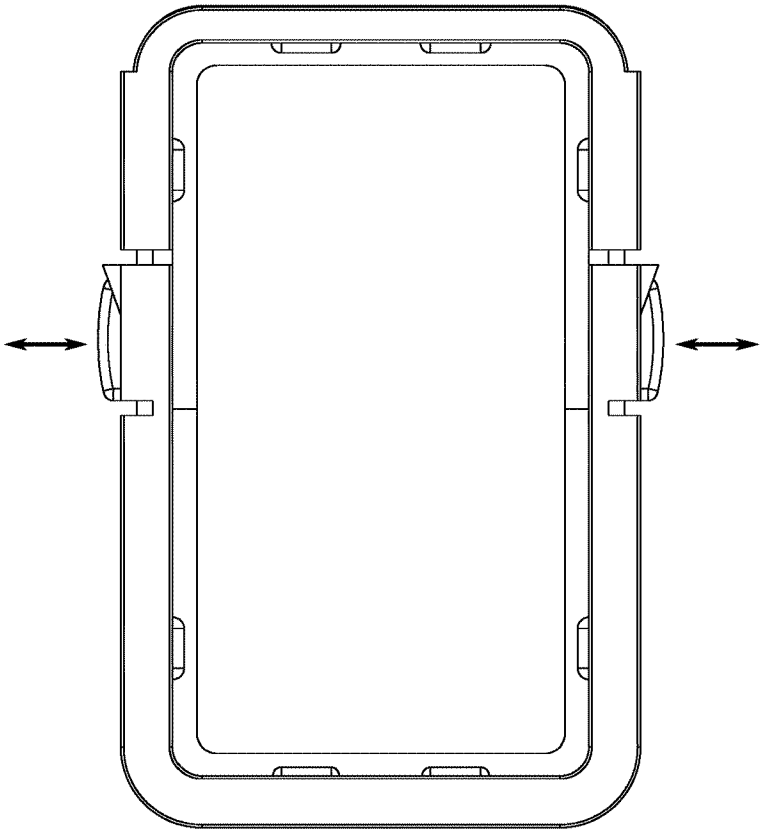
FIG. 5 illustrates a top view of the bottom unit of the container with a security lock.

Referring first to FIGS. 1 and 2, in an embodiment a secured container 1 is provided. The container 1 may have a top unit 10 and a bottom unit 50. The container 1 may be especially suitable for securing an item 845, such as medication, which can potentially be harmful to individuals, such as children, whom might otherwise gain access to the item (such as medicine) from a non-secure container. In an embodiment, the container 1 is largely made of a durable material, such as plastic and/or metal. In one embodiment, the container 1 is largely made of tin. The container 1 is especially suitable for preventing children from accessing the items 845 of the container 1 when the container 1 is sealed.

Figure 3:
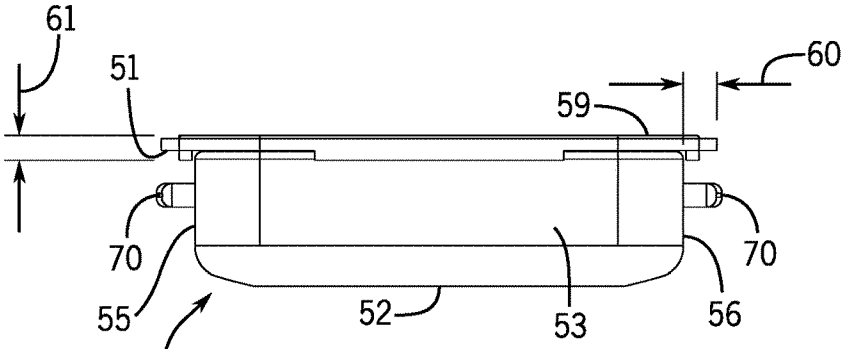
FIG. 3 illustrates a front view of the bottom unit of the container with a security lock.
Figure 4:
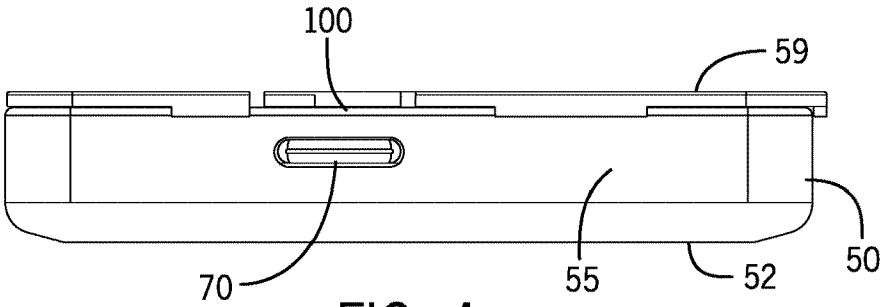
FIG. 4 illustrates a side view of the bottom unit of the container with a security lock.
Figure 6:
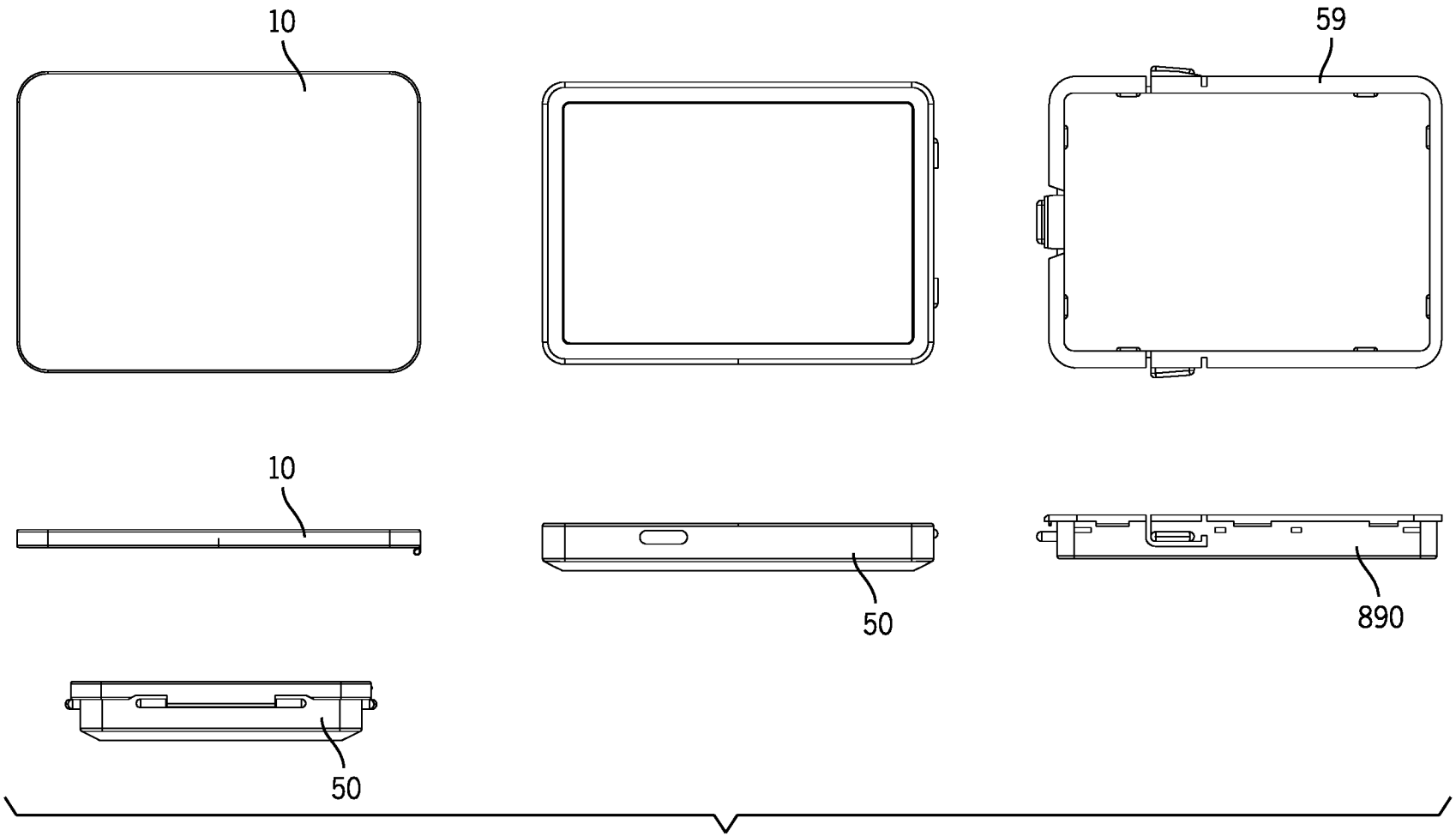
FIG. 6 illustrates an engineering drawing of the individual units of the container with a security lock in one embodiment.

The bottom unit 50 may have a top 51 (FIG. 3), a bottom 52, a front 53, a back 54, a first side 55, a second side 56 and a generally hollow interior 57 for storing the items 845. An extended top edge 59 may be located on the top 51 of the bottom unit 50, extending around the entire perimeter of the top 51 of the bottom unit 50. The extended top edge 59 may have a perimeter edge which extends a distance 60 (FIG. 3) away from the sides 55, 56, the front 53 and the back 54 of the bottom unit 50. Further, in an embodiment, the extended top edge 59 may have a thickness (or width) 61 which acts as a securing mechanism for the top unit 10, as discussed below.

In an embodiment, the first side 55 and the second side 56 may each have an extended bump 70. The extended bump 70 may allow a user to grasp and to more easily slightly push in the sides 55, 56 of the bottom unit 50 so as to separate the bottom unit 50 from the top unit 10 (or rotate the top unit 10 away from the bottom unit 50 in the embodiment of FIG. 10 wherein the hinge is utilized). Further, the extended top edge 59 of the bottom unit 50 may have a first tab 100 and a second tab 101 wherein the first tab 100 and the second tab 101 are on different sides 55, 56 of the bottom unit 50. In an embodiment, the extended bumps 70 are located directly below the first tab 100 and the second tab 101 of the bottom unit 10 so as to make pressing both easy.

Figure 7:
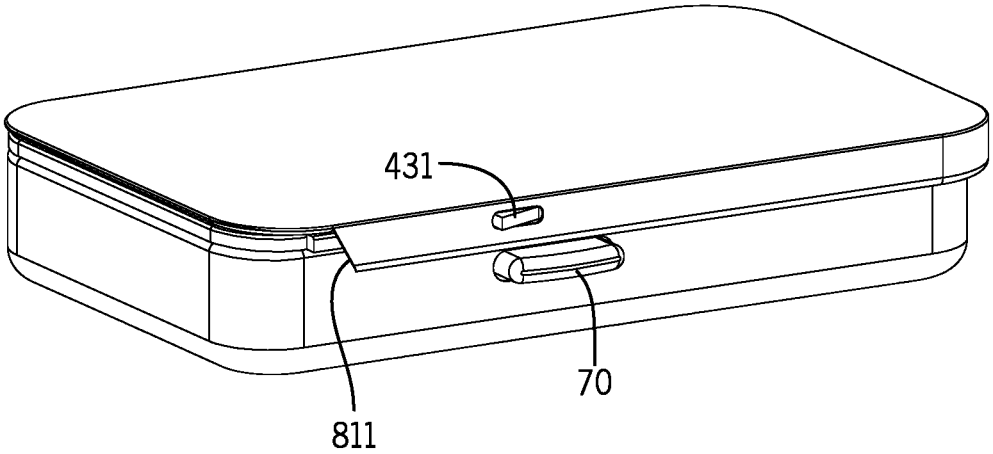
FIG. 7 illustrates a side view of an alternative embodiment of the container with a security lock.

The first tab 100 and the second tab 101 may have a space 110 located on each side of the first tab 100 and the second tab 101. The spaces 110 may allow the first tab 100 and the second tab 101 to move or pivot with respect to the extended top edge 59 by, for example, slightly bending at the crease or connection point of the first tab 100 and the second tab 101. The first tab 100 and second tab 101 may each have a front end 102 and a back end 103. The back end 103 of the first tab 100 and the second tab 101 may have, in an embodiment, a generally triangular extension 105 which may allow a user to more easily push the first tab 100 and the second tab 101 (and also extended bumps 70 together with one finger each) to unlock the top unit 10 from the bottom unit 50 (as discussed below). As shown in the figures, the space 110 at the back end 103 of the first tab 100 and the second tab 101 completely separates the perimeter of the extended top edge 59, whereas the space 110 at the front 102 of the first tab 100 and the second tab 101 does not completely separate the extended top edge 59. As a result, the back end 103 of the first tab 100 and the second tab 101 move inward more than the front end 102 of the first tab 100 and the second tab 101 and therefore allow the triangular extensions 105 of the first tab 100 and the second tab 101 to move inward and outward with respect to the openings 431 (FIG. 7) of the top unit 10 to lock and unlock the top unit 10 with respect to the bottom unit 50.

In an embodiment, the container 1 may have an internal slits 612 (visible in FIG. 2). The internal slits 612 may be located directly under and parallel to the first tab 100 and the second tab 101. The back end 103 of the first tab 100 and the second tab 101 may be connected to the slits 612. The slits 612 may have a length equal to the length of the first tab 100 and the second tab 101. In an embodiment, the slits 612 may allow the first tab 100 and the second tab 101 to slightly bend inward more easily to operate the container 1 by allowing the top unit 10 to be removably secured to the bottom unit 50 by allowing the first tab 100 and the second tab 101 to slightly bend.

Figure 8:
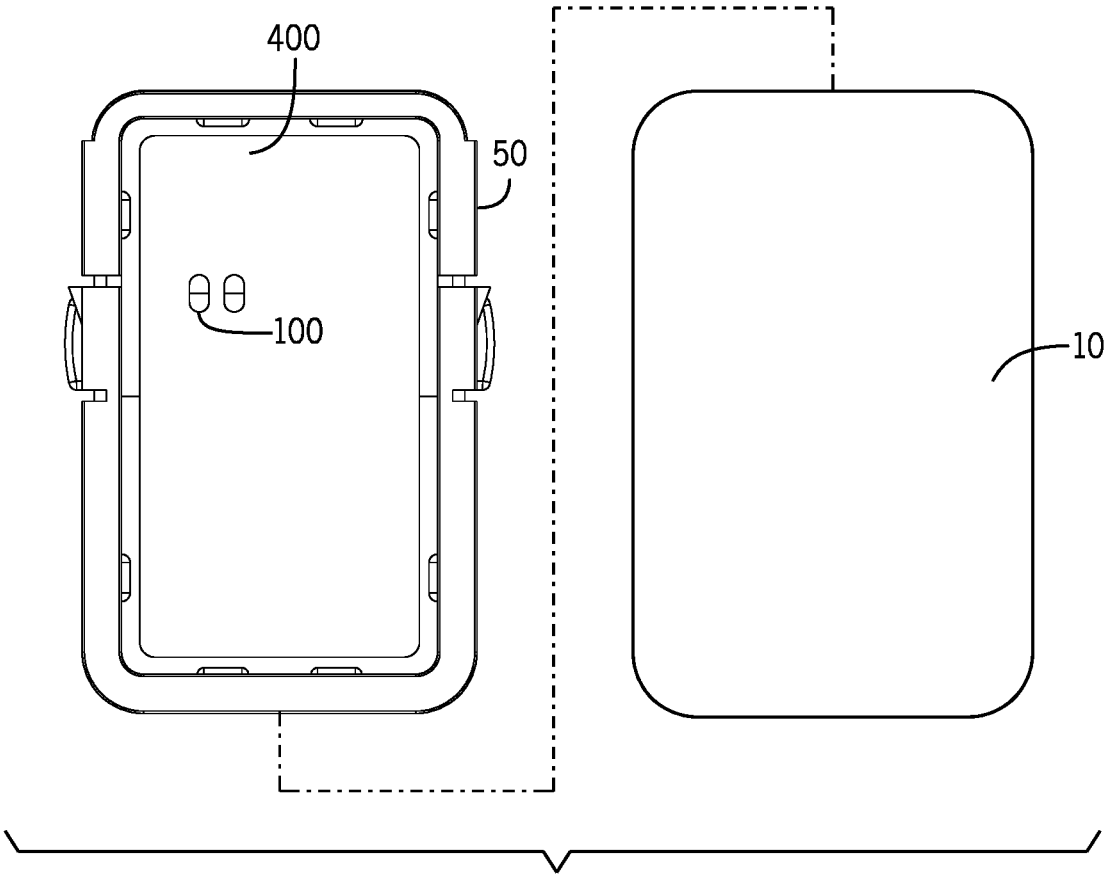
FIG. 8 illustrates the top unit in the process of being attached to or removed from the bottom unit.
Figure 9:
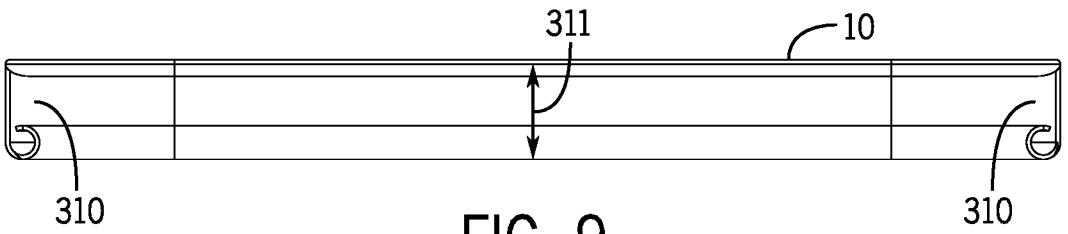
FIG. 9 illustrates a side cross-sectional view of the top unit wherein the groves are visible.

In an embodiment, to secure the top unit 10 to the bottom unit 50 the top unit 10 is first slid over a portion of the extended top edge 59 of the bottom unit 50, as shown in FIG. 8. In particular, an extended groove 310 (FIG. 9) on each side of the interior of the top unit 10 receives a portion of the extended top edge 59 when the top unit 10 is secured to the bottom unit 50. As a result, the thickness 61 of the extended top edge 59 is slightly less than the height 311 of the extended grooves 310 so that the top unit 10 may be secured to the bottom unit 50.

In an embodiment, the bottom unit 50 may have a removable tray portion 400 which be changed. In one embodiment, the extended top edge 59 and the first tab 100 and the second tab 101 may actually be part of the removable tray 400 (FIG. 8) and not the bottom unit. Further, the removable tray 400 may be made of plastic, metal or other durable material which may also help protect the items 845 of the container 1. In an embodiment, the extended top edge 59 of the bottom unit 50 create an air-tight and/or liquid tight seal with respect to the top unit 10 when the top unit 10 is secured to the bottom unit 50. As a result, the items 845 of the interior of the container 1 are protected.

To secure the top unit 10 to the bottom unit 50, the extended grooves 310 of the top unit 10 are aligned with and slid over the extended top edge 59 of the bottom unit 50. While sliding extended groove 310 of the top unit 10 over the extended top edge 59 of the bottom unit 50, a leading edge 811 (FIG. 1) of the top unit 10 contacts, and slightly bends and forces inward the triangular portions of the first tab 100 and the second tab 101 so that the first tab 100 and the second tab 101 lock into the openings 431 (FIG. 7) of the top unit 10 and the top unit 10 and bottom unit 50 are then secured together as one. Preferably the leading edge 811 is angled between thirty-five and fifty-five degrees with respect to the top surface of the top unit 10. The first tab 100 and the second tab 101 may bend as a result of the spaces 110 allowing the first tab 100 and the second tab 101 to slightly bend. To remove the top unit 10 from the bottom unit 50 the reverse process is done. More specifically, a user presses the extended bumps 70 and the first tab 100 and the second tab 101 of the bottom unit 50 together, therein compressing the sides 55, 56 of the bottom unit 50 so that the first tab 100 and the second tab 101 are no longer in the openings 431 of the top unit 10. A user then may slide the top unit 10 off from the bottom unit 50. Further, in a method of use, because of the rigid nature of the top unit 10, a user may also need to press the dead center area of the top unit 10 to slightly bend the perimeter of the top unit 10 slightly outward while, at the same time, pressing the first tab 100 and the second tab 101 and the extended bumps 70 and also sliding the top unit 10 with respect to the bottom unit 50 to release the top unit 10 from the bottom unit 50.

Figure 10:
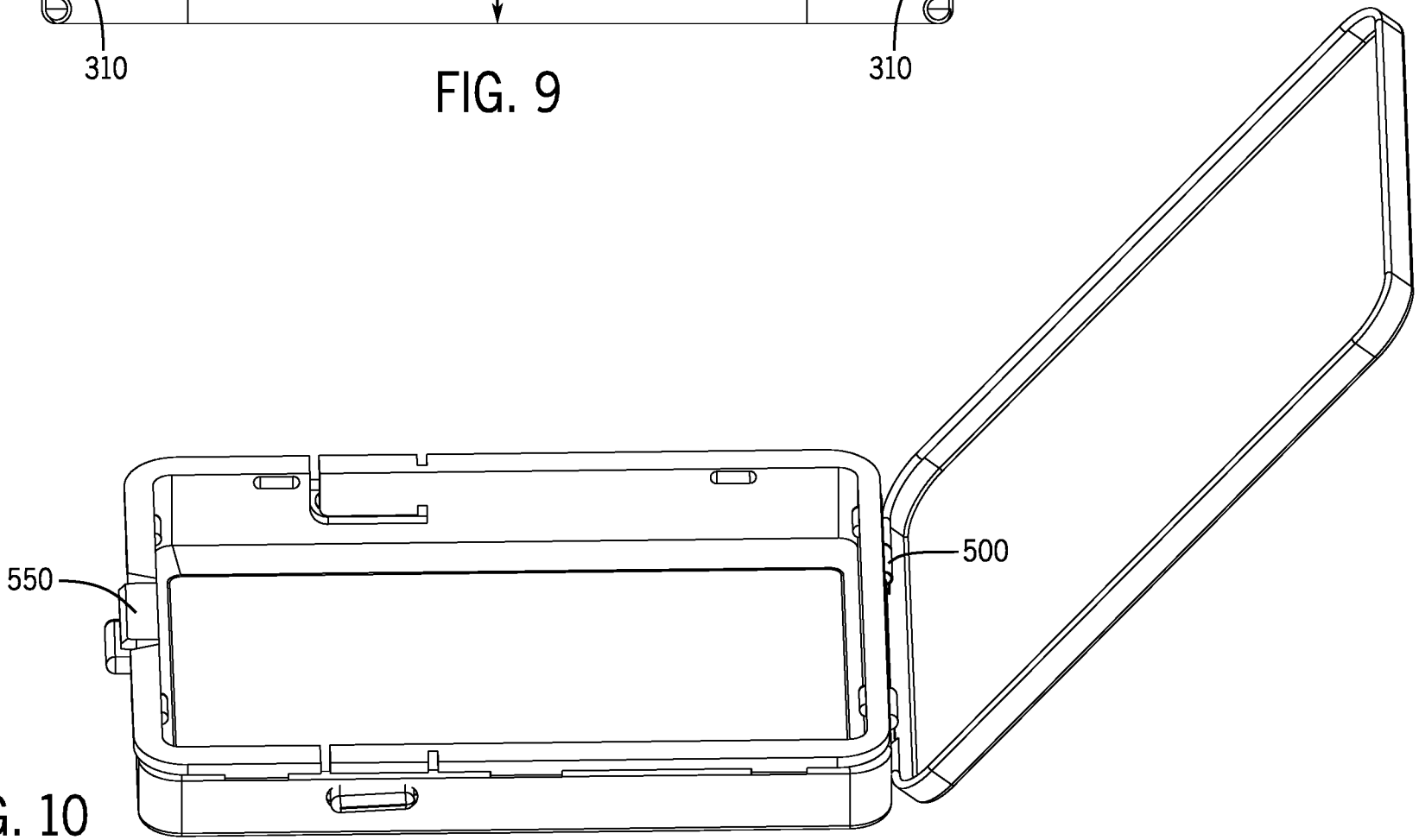
FIG. 10 illustrates an alternative embodiment of the container wherein a hinge is used to rotate the top unit from the bottom unit.

Referring now to FIG. 10, in an embodiment, a lock 550 may be incorporated on the bottom unit 50 to further lock the bottom unit 50 to the top unit 10. In this embodiment, the lock 550 may be located at, for example, the front 53 of the bottom unit 50. Further, in an embodiment, a hinge 500 may allow the top unit 10 to rotate with respect to the bottom unit 50 so that the two units are always connected.

Figure 11:
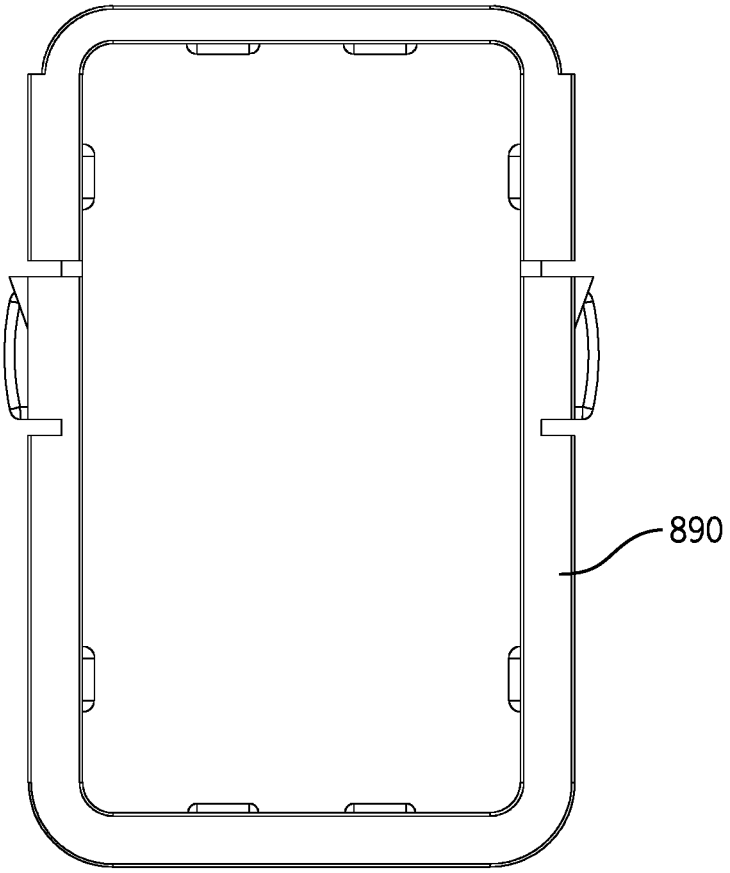
FIG. 11 illustrates an embodiment wherein the device has a removable frame having an open bottom which is inserted into the bottom unit.

Finally, referring now to FIG. 11, in an embodiment, a removable frame 890 may be used in connection with the container 1. The removable frame 890 may be placed within the bottom of the device. The removable frame 890 may lack a bottom so that items 845 stored in the container 1 rest directly on the bottom of the container.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

I claim:

1. A container for storing items comprising:

a top unit having a top surface, a bottom, a front, a back, a first side, a second side and an interior;

a bottom unit having a front panel having a top edge, a back panel having a top edge, a first side panel having a top edge and a second side panel having a top edge wherein the top edges of the front panel, the back panel, the first side panel and the second side panel form a top edge perimeter and wherein the top edge perimeter extends outward from the front panel, back panel, first side panel and second side panel and wherein the bottom unit has a hollow interior;

a first tab on the top edge of the first side panel of the bottom unit and a second tab on the top edge of the second side panel of the bottom unit wherein the first tab and the second tab each have a front and a back;

a first space located along the top edge of the perimeter of the bottom unit at the back of the first tab and a second space located along the top edge of the perimeter of the bottom unit at the back of the second tab;

wherein the first tab of the bottom unit is capable of moving with respect to the first side panel of the bottom unit;

wherein the second tab of the bottom unit is capable of moving with respect to the second side panel of the bottom unit;

a first opening on the first side of the top unit and a second opening on the second side of the top unit;

wherein the bottom unit and top unit are capable of temporarily being secured together a first slit located on the first side panel of the bottom unit wherein the first slit is located beneath the first tab and parallel to the first tab and wherein the first slit is of equal length as the first tab; and a second slit located on the second side panel of the bottom unit wherein the second slit is located beneath the second tab and parallel to the second tab and wherein the second slit is of equal length as the second tab.

2. The container for storing items of claim 1 wherein the first tab of the bottom unit is removably secured within the first opening of the top unit.

3. The container for storing items of claim 2 wherein the second tab of the bottom unit is removably secured within the second opening of the top unit.

4. The container for storing items of claim 1 further comprising:

a triangular extension on the first tab.

5. The container for storing items of claim 4 further comprising:

a triangular extension on the second tab.

6. The container for storing items of claim 1 wherein the top unit is rigid.

7. The container for storing items of claim 1 further comprising:

an extended bump located on the first side of the bottom unit wherein the extended bump is located directly below the first tab.

8. A method of securing items within a container comprising the steps of:

providing a container having a top unit having a top surface and having a first opening on a first side and a second opening on a second side;

providing a container having a bottom unit having a first tab on a first side and a second tab on a second side;

wherein the first tab of the bottom unit is temporarily locked within the first opening of the top unit and wherein the second tab of the bottom unit is temporarily locked within the second opening of the top unit;

pressing the first tab and the second tab of the bottom unit while simultaneously sliding the top unit with respect to the bottom unit in order to remove the top unit from the bottom unit; and simultaneously pressing a center of the top surface of the top unit while pressing the first tab and the second tab and sliding the top unit with respect to the bottom unit to release the top unit from the bottom unit.

* * * * *